US007422022B2

(12) United States Patent
Maunsell et al.

(10) Patent No.: US 7,422,022 B2
(45) Date of Patent: Sep. 9, 2008

(54) DISHDRAWER-CAMMING ARRANGEMENT

(75) Inventors: Steve Maunsell, Dunedin (NZ); Robert William Todd, Dunedin (NZ)

(73) Assignee: Fisher & Paykel Appliances Limited, Auckland (NZ)

( * ) Notice: Subject to any disclaimer, the term of this patent is extended or adjusted under 35 U.S.C. 154(b) by 0 days.

(21) Appl. No.: 11/284,208

(22) Filed: Jan. 24, 2006

(65) Prior Publication Data

US 2006/0151011 A1 Jul. 13, 2006

Related U.S. Application Data

(63) Continuation of application No. 10/110,117, filed as application No. PCT/NZ00/00193 on Oct. 5, 2000, now Pat. No. 7,152,612.

(30) Foreign Application Priority Data

Oct. 8, 1999 (NZ) ..... 500167

(51) Int. Cl.
*B08B 3/02* (2006.01)
*A47L 15/00* (2006.01)

(52) U.S. Cl. ..... 134/58 D; 134/200; 312/228

(58) Field of Classification Search ..... 134/56 D, 134/57 D, 58 D, 165, 200; 312/228
See application file for complete search history.

(56) References Cited

U.S. PATENT DOCUMENTS

| | | | | |
|---|---|---|---|---|
| 4,179,307 | A | 12/1979 | Cau et al. | |
| 4,303,249 | A | 12/1981 | Illy | |
| 4,572,596 | A | 2/1986 | Weir et al. | |
| 4,739,781 | A | 4/1988 | Casoli | |
| 4,995,650 | A * | 2/1991 | Schantz et al. | 292/201 |
| 5,611,609 | A | 3/1997 | Katz et al. | |
| 5,743,281 | A | 4/1998 | Sargeant et al. | |
| 5,755,244 | A | 5/1998 | Sargeant et al. | |
| 6,260,565 | B1 | 7/2001 | Welch et al. | |
| 6,622,740 | B1 | 9/2003 | Durazzani | |

FOREIGN PATENT DOCUMENTS

| | | |
|---|---|---|
| DE | 3541777 | 5/1987 |
| DE | 3843040 | 6/1990 |
| EP | 493234 | 7/1992 |
| FR | 2751045 | 1/1998 |
| GB | 2201886 | 9/1988 |
| JP | 10080390 | 3/1998 |
| WO | WO 9312706 | 7/1993 |
| WO | WO 9833426 | 8/1998 |
| WO | WO 9945188 | 9/1999 |
| WO | WO 0016681 | 3/2000 |

* cited by examiner

*Primary Examiner*—Joseph L Perrin
(74) *Attorney, Agent, or Firm*—Trexler, Bushnell, Giangiorgi, Blackstone & Marr, Ltd.

(57) ABSTRACT

A dishwasher is disclosed which is suitable for mounting within a cavity under a bench. The dishwasher is chassis less and includes no outer wrapper or cabinet and as such is mounted directly to the cavity. Also disclosed are a number of embodiments relating to mechanisms for closing the lid on the retractable drawer wash system and various methods for sealing the lid onto the wash drawer.

9 Claims, 17 Drawing Sheets

DISHDRAWER-CAMMING ARRANGEMENT

This application is a continuation application of application Ser. No. 10/110,117, filed on Aug. 2, 2002 and entitled "Dishwasher", now U.S. Pat. No. 7,152,612, which is the national phase filing of PCT/NZ00/00193, filed on Oct. 5, 2000, Published as WO 01/26532 on Apr. 19, 2001. The subject matter of Ser. No. 10/110,117 is incorporated herein by reference.

TECHNICAL FIELD

This invention relates to dishwashers and in particular but not solely to a dishwasher of the type disclosed in the applicant's international patent specification WO 93/12706.

BACKGROUND ART

The dishwasher of WO 93/12706 has a form generally indicated in FIGS. 1 and 2 and installation options as shown in FIGS. 4 to 6. The dishwasher disclosed in WO 93/12706 differs from conventional dishwashers in that a wash chamber and associated wash system is slidably mounted in the form of a drawer within a cabinet and the chamber is withdrawn horizontally to allow loading through the open top of the chamber. When the chamber is retracted an associated lid sealably closes off the top of the chamber to contain wash liquid in operation. The dishwasher of WO 93/12706 includes a cabinet or wrapper 203 wherein which all working components are housed. The cabinet acts as a chassis and a high finish wrapper. In use dishwashers are usually mounted in kitchen joinery and rarely used in a free-standing mode. When so used the presence of a high finish wrapper is redundant and constitutes an unnecessary manufacturing cost.

In WO 93/12706 the wash chamber lid is of unitary construction movably retained in the top of the cabinet and engaged by the wash chamber on retraction to move down onto the top of the wash chamber using a parallelogram linkage and cam mechanism. In practice it has been found that other types of wash chamber covers may be satisfactory and may have better production economics.

WO 98/33426 discloses a dishwasher similar to that depicted in FIGS. 1-6. In one preferred form it uses an inflatable gasket to seal the drawer when it is retracted into the cabinet. However, this may affect product reliability and impact on user satisfaction. The gasket inflation and deflation time may inconvenience the user with respect to the delays in opening the drawer mid-cycle and the rubber gasket may deteriorate over time creating maintenance problems.

DISCLOSURE OF INVENTION

It is an object of the present invention to provide a dishwasher of the type described which goes some way towards overcoming the above-mentioned disadvantages, or which will at least provide the public with a useful choice.

Accordingly in a first aspect the present invention consists in a washing appliance comprising:

(a) a wash system slidably mounted in such a way that it may be withdrawn horizontally for access thereto, said wash system including:

(i) an open top wash chamber adapted to accommodate items to be washed and within which wash liquid is circulated, said wash chamber having a top peripheral rim, (ii) means for introducing and circulating wash liquid within said chamber, (iii) means for evacuating wash liquid from said chamber, and (b) a wash chamber closure, and (c) a cam arrangement including a cam surface adapted to connect to a stationary point, a cam-follower connected to said closure and adapted to interact with said cam surface, and an elastically deformable member adapted to be compressed between said cam-follower and a stationary point, to provide the closure with two degrees of freedom such that an inwardly directed force causes said closure to move inwardly and downwardly and an outwardly directed force causes said closure to move outwardly and upwardly, and complementary abutting means provided on said closure and said wash chamber, said means abutting on substantially full retraction of said wash chamber and on initial withdrawal of said wash chamber with continued displacement of said wash chamber after abutment providing respective closing and opening forces to said closure to cause it to close against or open away from said wash chamber opening.

Preferably when said chamber is fully retracted to the entire downward force on said closure is provided by said elastically deformable member.

Preferably said elastically deformable member is a torsional spring

In a further aspect the invention comprises a washing appliance comprising:

a wash system slidably mounted in said appliance in such a maimer that it may be withdrawn horizontally for access thereto, said wash system including:

(a) an open top wash chamber adapted to accommodate items to be washed and within which wash liquid is circulated, said wash chamber having a top peripheral rim, (b) a wash chamber lid including a perimeter seal to seal on said top peripheral rim, and said lid suspended in said appliance so as to be moveable from an outer position to an inner position, (c) a cam surface sloping downward from an outer location to an inner location, separated by a horizontal distance equivalent to the horizontal spacing of said inner and outer position of said lid, (d) an abutment on said wash system, (e) a complimentary abutment on said lid, (f) a cam follower on said lid that cooperates with said cam surface as said lid moves between said inner and outer positions, to direct the path of said lid in moving from said outer to said inner position, to an inward and downward movement, followed by an inward movement, and the abutments meeting when the wash system is substantially retracted, with continued movement of said wash system to a fully retracted location forcing said lid from said outer position to said inner position, and with the downward motion thus imparted to the lid thereby bringing said seal into contact with said peripheral rim in synchronization with the motion of said wash system.

Preferably said washing appliance including a return spring acting between said appliance and said cam follower, to bias said lid to said outer position when said wash system withdraws from said appliance.

Preferably said camming surface is substantially stationary with respect to said appliance.

In a further aspect the invention comprises a dishwasher constructed according to the washing appliance as claimed in any one of the preceding claims.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

The invention consists in the foregoing and also envisages constructions of which the following gives examples.

BRIEF DESCRIPTION OF THE DRAWINGS

One preferred form of the present invention will now be described with reference to the accompanying drawings in which.

MODES FOR CARRYING OUT THE INVENTION

Figure 1:
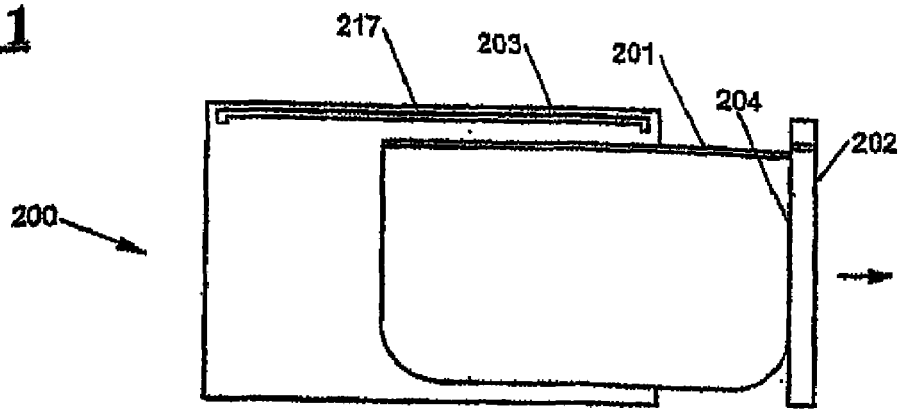
FIG. 1 shows in diagrammatic form a drawer type dishwasher.
Figure 2:
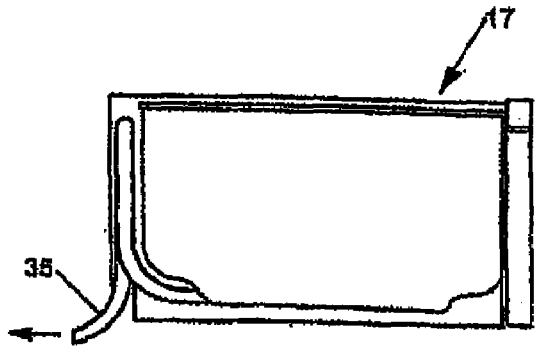
FIGS. 2 and 3 shows in diagrammatic form the dishwasher plumbing and wiring system with the wash chamber in the closed and open positions respectively.
Figure 3:
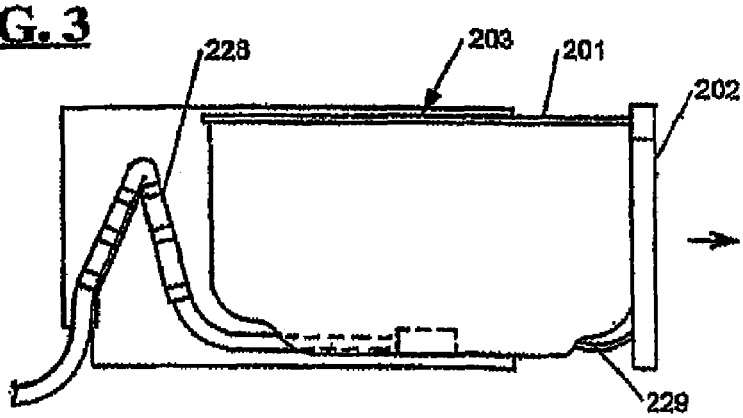

The present dishwasher 200 is of the type illustrated in FIG. 1. A wash chamber 201 (with all wash system components) fitted with a front panel 202 is slidably mounted within a cavity 203 in a 'drawer' arrangement. The wash chamber has an open top and is withdrawn from the cavity in the direction of the arrow to allow loading and unloading of dishes and is retracted into cavity 203 during washing. The wash and drain systems are fitted within wash chamber 201 including a motor and pumps. Flexible connecting wiring and plumbing 228 couple the wash chamber to the relevant terminations within the cavity in the manner indicated in FIGS. 2 and 3. The dishwasher controller may be mounted in the cabinet or in the sliding wash system.

Figure 4:
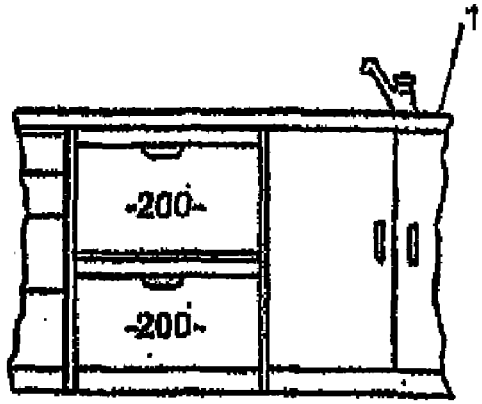
FIGS. 4 to 6 show a selection of ways in which dishwashers of the type in WO 93/12706 and in the present specification may be mounted in a modular fashion in a kitchen installation.
Figure 5:
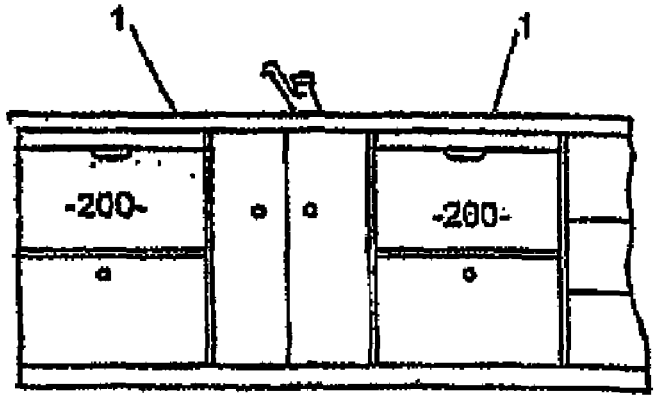
Figure 6:
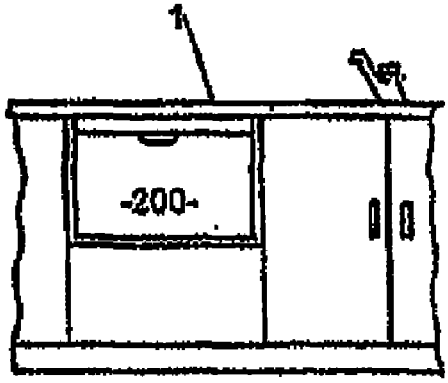

The dishwasher is usually constructed with a height dimension approximately half that of conventional front-loading domestic dishwashers. In this form it can be used alone or as one of a number, more usually one of a pair of such dishwashers. FIGS. 4 to 6 show installation concepts using one or two dishwashers using this modular concept. In FIG. 4, two such dishwashers 200 are shown stacked one above the other under a sink bench 1 which will typically be between 850 and 900 mm above floor level. In FIG. 5 two dishwashers 200 are shown mounted one on either side of a sink forming part of the sink bench 1. In FIG. 6 only a single dishwasher 200 is provided under a sink bench 1. Because of the reduced height dimension a dishwasher according to the invention could also be bench mounted.

From FIG. 4 it can be seen that when two modular dishwasher units 200 are stacked one above the other the configuration is similar in external dimensions to conventional dishwashers. Two modular units 200 installed side by side immediately under a bench top as in FIG. 5 offer the same capacity as a conventional dishwasher but avoid the inconvenience of a user having to bend down to reach the lower half of the dishwasher.

Figure 7:
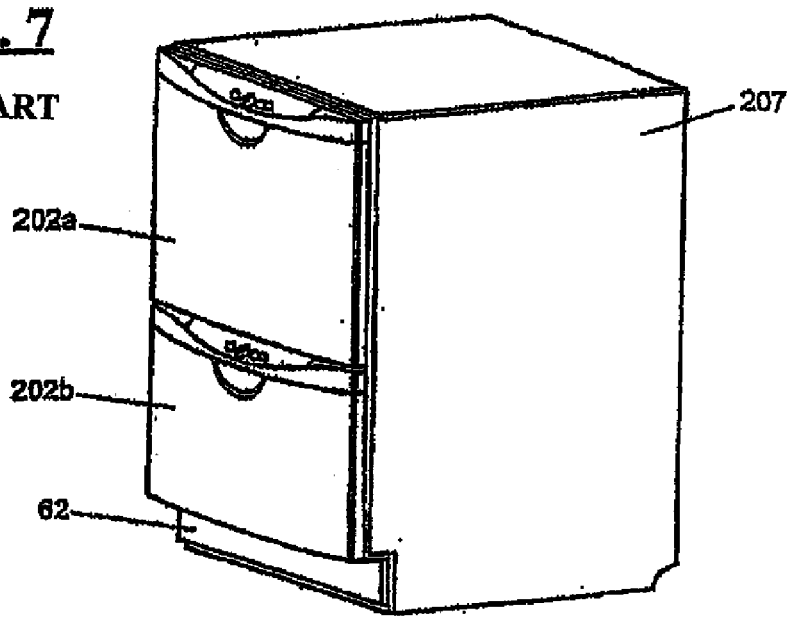
FIG. 7 PRIOR ART
FIG. 7 shows a 'two drawer' single cabinet dishwasher according the prior art.

Some pair arrangements could be manufactured as such rather than pairing two individual modules at installation. For example the two dishwasher 'over and under' configuration shown in FIG. 4 can be manufactured in a single external envelope or cabinet and provided for installation as a unitary machine. Such a two drawer machine is shown in FIG. 7, comprising a single cabinet 207 which houses two drawer type wash chambers 202*a* and 202*b*. The drawer fronts are each provided with an aesthetically pleasing facia.

A two drawer machine of this type allows for considerable flexibility in operating modes. These include:

1. One module operating, or two modules operating simultaneously with a mixed dish load. With each module capable of accommodating the largest item of dish load, this concept offers an increased capacity for large items.

2. One or both modules operating, but not necessarily simultaneously, where each module has either lightly soiled or heavily soiled dish load, and the appropriate wash programme set to suit the individual module.
3. One module being gradually filled with soiled dishes, while the second module is being emptied only as its clean dish load is being reused. For reasons of hygiene this is not practical with single dishwashers
4. One module programmed for lightly soiled loads and the other module for heavily soiled loads.
5. One module switched on as soon as it has been filled with soiled dishes. That is, smaller loads may be efficiently washed.

Base Module

Figure 8:
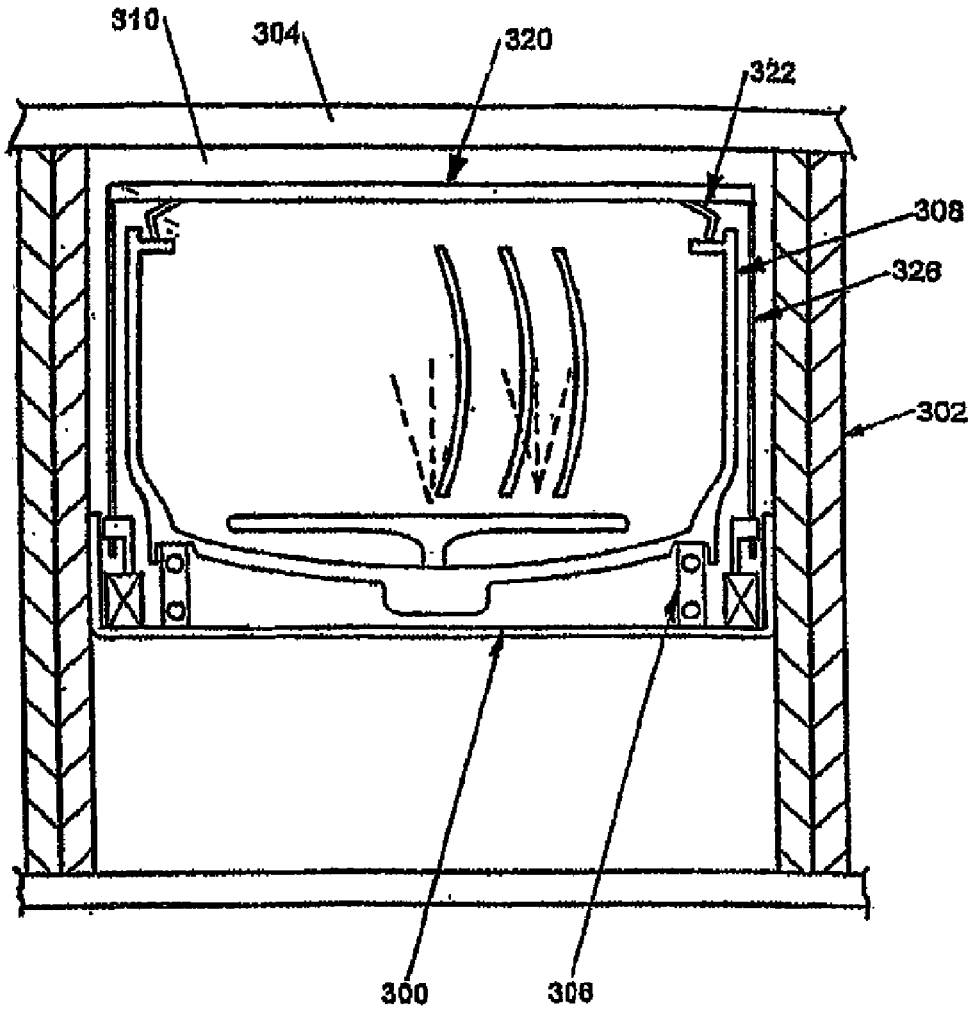
FIG. 8 is a front view of an embodiment of the present invention showing the wash system mounted underneath a bench with the front of the drawer cutaway.
Figure 9:
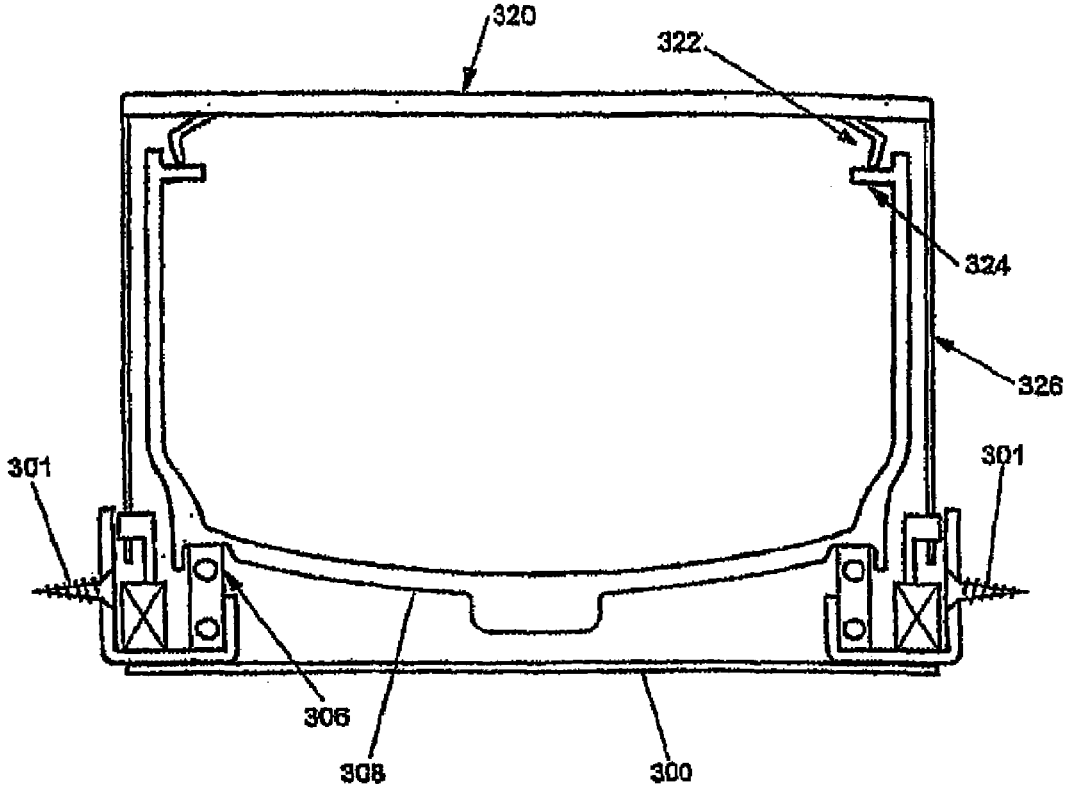
FIG. 9 is a more detailed view of the wash system shown in FIG. 8.

Whereas previous versions of drawer type dishwashers have included a cabinet and chassis the improvement that is the preferred embodiment of the present invention, shown in FIGS. 8 and 9, provides a dishwashing system which is directly fixed to joinery and does not include a cabinet or chassis. The base module 300 may be attached by any suitable fastening means 301 such as bolts or wood screws into the adjacent vertical members 302 inside the cavity 310. The base module 300 being thus restrained, when the wash chamber 308 is withdrawn, any racking forces will be borne by the vertical members 302 of the bench 304.

The wash chamber 308 is slidable in arid out of the cavity 310 by means of sliding rails 306 integrated with the base module 300. In the preferred embodiment of the present invention, the base module 300 effectively comprises the mounting between the sliding rails 306 and the vertical members 302 and provision for water supply and waste. In this fashion as previously described, two such washing modules might be located in the same cavity in the under and over configuration, or side by side in adjacent cavities.

Drawer Closure

In a washing machine as proposed here, where the wash chambers are mounted as sliding drawers, the closing of the chambers prior to commencement of the wash cycle is more complicated than with conventional front loading or above-bench top loading machines. It is undesirable to have users manually close a door to seal the open-topped wash chamber prior to pushing the extended 'drawer' back into the cavity. It is preferable to have a closure which is actuated by the action of retracting the wash chamber back into the cabinet.

In FIG. 1, a rigid closure or lid 217 is diagrammatically shown which is mounted in the top of the cabinet 203 for closing the open top of wash chamber 201. Closure can be effected by mounting the lid in such a way as to allow it to be mechanically forced downwardly on to the rim of wash chamber 201 as the chamber is retracted into cabinet 203. One means for achieving this type of sealing action is disclosed in WO 93/12706, which utilises mechanical linkages in a parallelogram fashion to seal the drawer during the last portion of travel of the wash chamber. The present invention in contrast, with no cabinet or chassis, thus provides alternative solutions.

Figure 11:
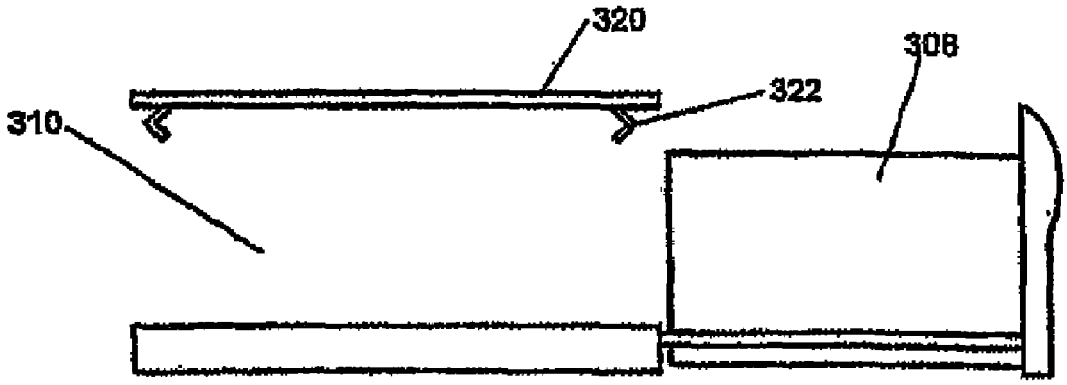
FIG. 11 is a side view of the present invention with the drawer pulled out.

In the preferred embodiment of the present invention (FIGS. 8-9) the lid 320 forms part of a bracket 326, which effectively loops over the top of the drawer when closed, and mounts at its base to the base module 300. The drawer lid 320 is shown in FIGS. 8 and 9 in a "closed position", whereby the gasket 322 is compressed between the lid 320 and the rim 324 of the wash chamber 308. In FIG. 11 showing a cutaway side view, the lid 320 is shown in a raised position whereby the gasket 322 is unengaged with the wash chamber so that the wash chamber 308 can be freely withdrawn from the cavity 310.

Figure 27:
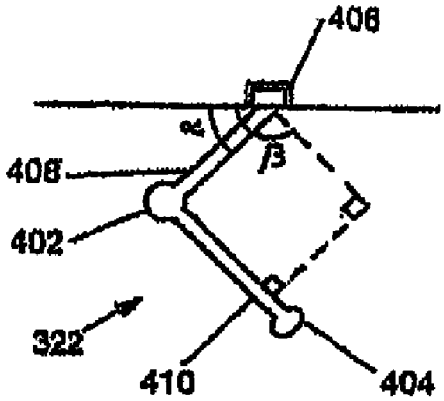
FIG. 27 is a side view of the lid gasket, in isolation.

The gasket 322, shown in more detail in FIG. 27, is effectively "L" shaped in cross section. There are two sealing edges, one edge 402 at the end the first flange 408 (attached to the lid about in a groove 406 running around the periphery thereof), and a second edge 404 at the end the second flange 410 (attached to the end of the first flange). When the lid is properly closed both flanges are deformed, and each of the sealing edges bears an approximately equal load. This provides an advantage over prior art dual lip seals, the respective lips of which generally do not bear equal loads, and therefore have unequal sealing effectiveness. While in the preferred embodiment the gasket is L shaped in cross section, it will still be effective if the angle of the first flange is less than 90° and the angle of the second flange is greater than 90° but less than 180°.

In a further improvement, the closure includes a moisture hood (not shown) around its periphery to ensure that when the drawer is withdrawn any excess steam is prevented from escaping into the cavity. As this cavity will typically be constructed from timber, even small amounts of residual moisture, would be detrimental. The hood might include an external vent to the front, so as to direct the steam out of the cavity.

Figure 10:
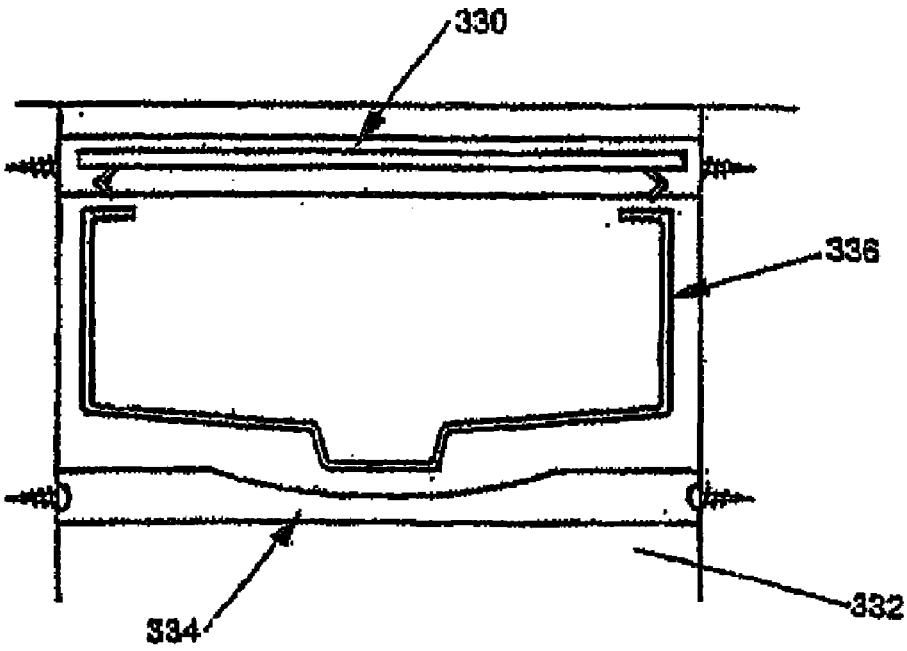
FIG. 10 is a front view of an embodiment of the present invention showing with the front of the drawer being cutaway.

Alternatively, as shown in FIG. 10, the lid 330 might be mounted separately within the cavity 332, individually from the base module 334 and wash chamber 336.

Closure Mechanism

As already described, it is preferable that the mechanical act of closing the drawer should activate the drawer closure. In the preferred embodiment of the present invention this is achieved by a mechanical arrangement connecting the closure to the base module.

Figure 25:
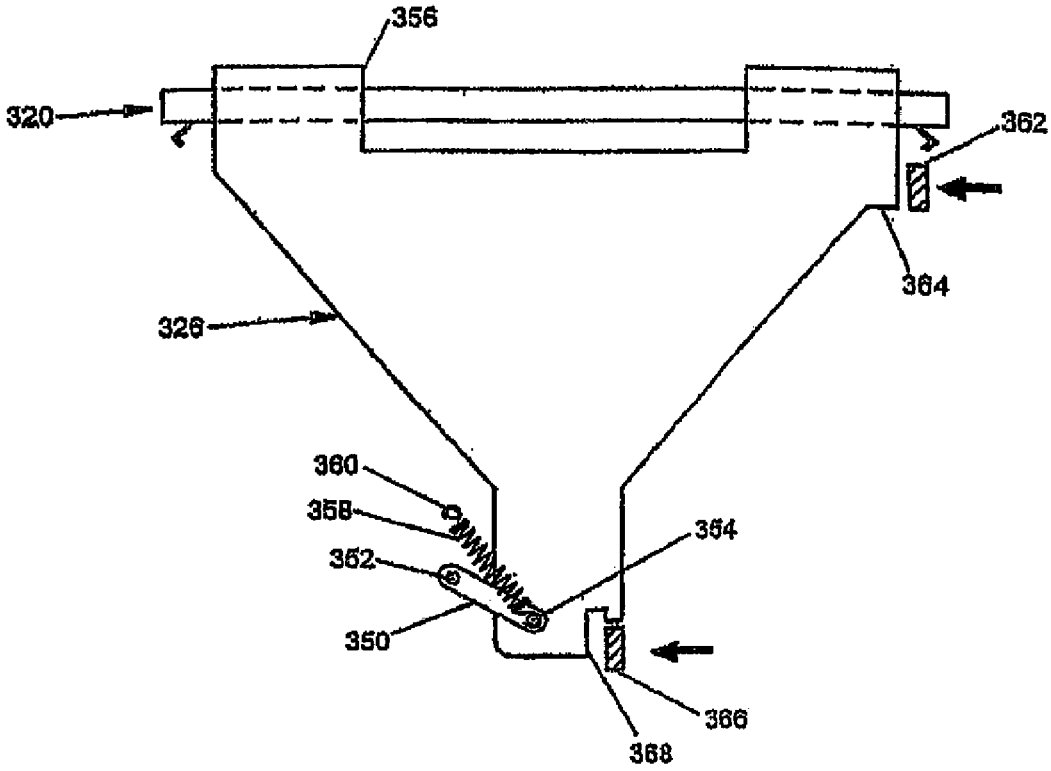
FIG. 25 is a side view of the closure opening mechanism using a hinged arm.
Figure 26:
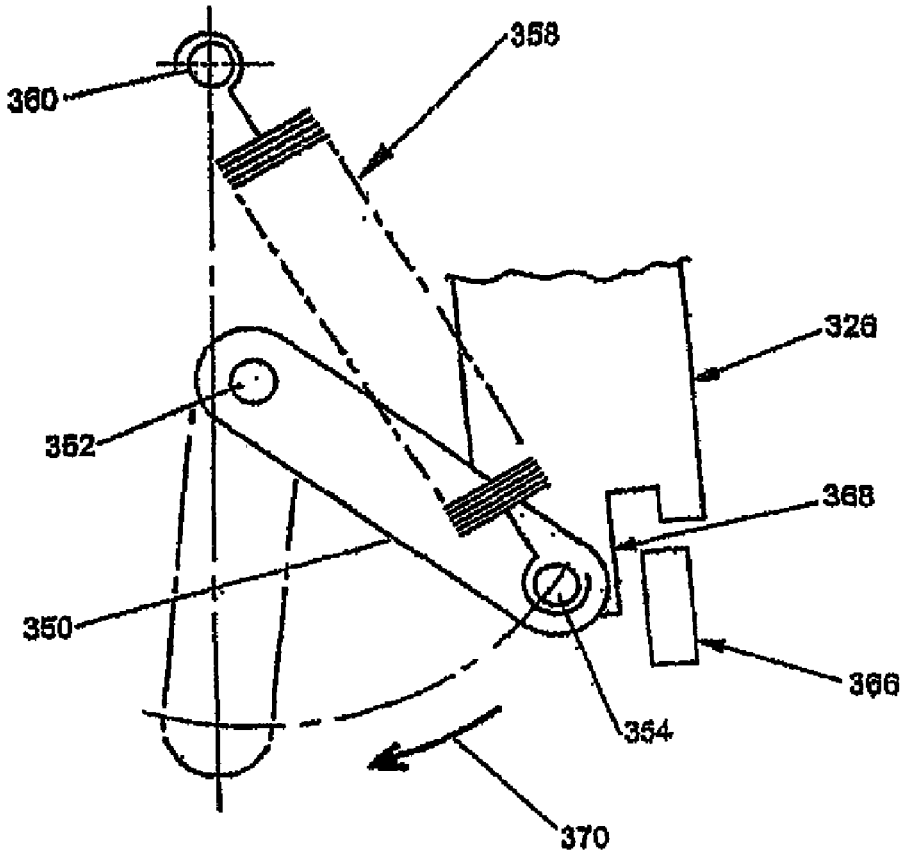
FIG. 26 is a detailed view of the linkage arrangement in FIG. 25 in isolation.

Referring now to FIGS. 25 and 26 a first such mechanical arrangement, is illustrated which secures the closure on the wash chamber when closed. A hinged link or arm 350, (one either side of the base module), is hingeably attached at one end 352 to the base module (300, FIG. 8), and hingeably attached at the other end 354 to the yoke 326. The yoke 326 is independent of the base module, and loops over the top of the wash chamber (308, FIG. 8) when fully retracted. The closure 320 is attached to the underside of the uppermost portions 356 of the yoke 326. A spring 358, (one either side of the base module), is hingeably attached at one end 360 to the base module (at a different point to where the hinged member is attached), and at the other end 354 is hingeably attached to the yoke 326 (at the same point at which the hinged arm is attached).

At two points on the sides of the wash chamber, are abutments 362, 366 which are designed to cooperate with matching abutments 364,368 on the yoke. When the wash chamber is slid into the retracted position, the chamber abutments 362,366 provide a horizontal force on the yoke abutments 364,368. The action, (370, FIG. 26) of the hinged members 350, converts this horizontal force into a combined vertical component and horizontal component force. This results in a downward and inward movement of the closure, as the retraction of the wash chamber is completed. In this fashion to a large extent as the lid comes down the gasket meets the outer lip of the wash chamber without substantial slippage, which would adversely affect sealing.

When the chamber is fully retracted the lower chamber abutment 366, becomes fully engaged with the yoke. As the chamber is slid inwardly, the yoke moves downwards, such that a further abutment 369 on the yoke, moves into a position behind the lower chamber abutment 366. Thus when the chamber is to be withdrawn the lower chamber abutment 366 acts on the further abutment 369, to force the yoke outwards. The action of the hinged arm transforms the outward force on the yoke, to outwards and upwards components, to a point where the lower chamber abutment 366 is unengaged with the further abutment 369 and the chamber may be freely withdrawn.

Figure 28:
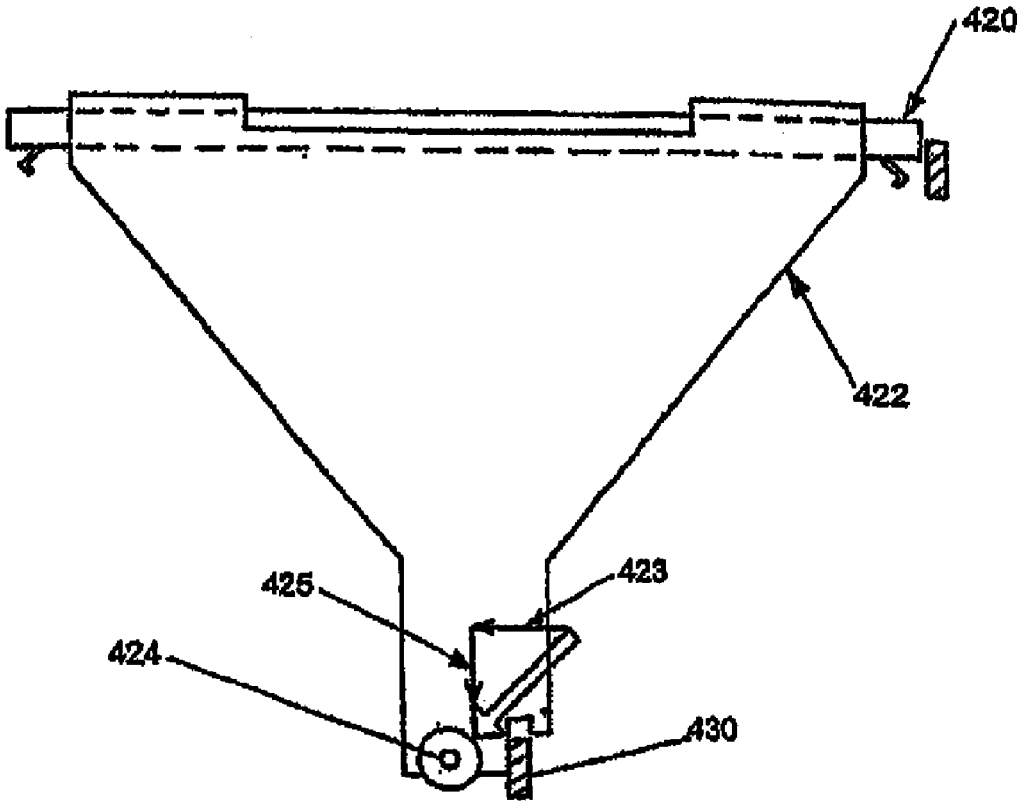
FIG. 28 is a side view of a closure and opening mechanism using a camming arrangement.
Figure 29:
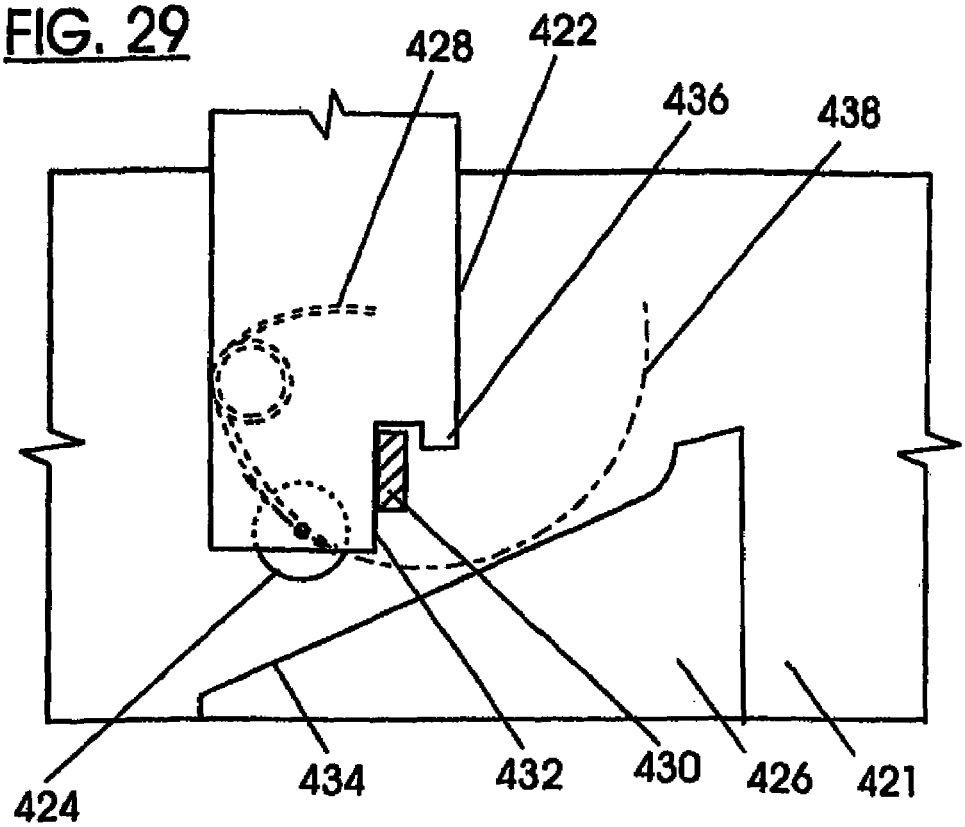
FIG. 29 is a section view of the camming arrangement shown in FIG. 28 with the wash chamber retracted and sectioned through a plane coincident with the exterior side surface of the wash chamber 201 and looking outwards at the camming arrangement.
Figure 30:
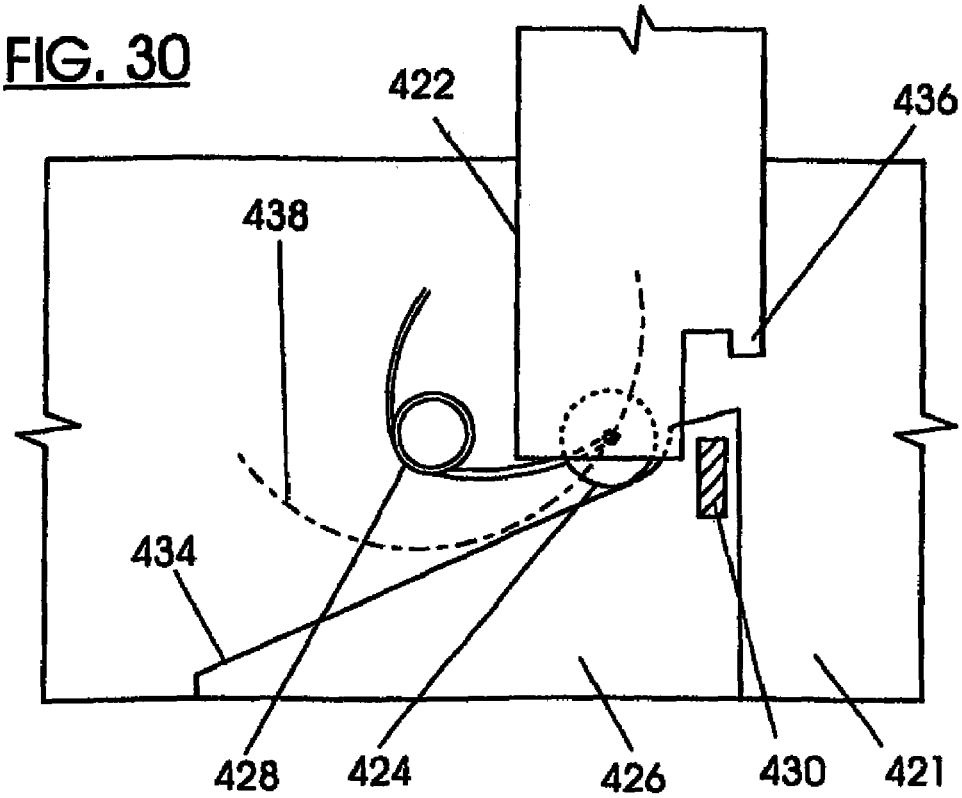
FIG. 30 is a section view of the cramming arrangement shown in FIG. 28 with the wash chamber partially withdrawn and sectioned through a plane coincident with the exterior side surface of the wash chamber 201 and looking outwards at the camming arrangement.

A further preferred mechanical arrangement is shown in FIGS. 28 to 30, which secures the closure on the wash chamber when closed. Again the closure 420 is suspended on the underside of the uppermost portion of the yoke 422. A roller or cam-follower 424, is attached at the base of the yoke 422, and during the opening and closing process, interacts with a cam 426 attached to the base module. A torsion spring 428 is connected between the base module 421 and the cam-follower 424, providing a primarily downward force on the yoke.

In FIG. 29 we see the wash chamber in its retracted position. As previously the chamber abutments 430 acting on the yoke abutments 432 force the yoke inwards 423, and the spring 428 forces the yoke downwards 425—the downward slope of the cam surface 434 allowing downward movement as the cam-follower 424 moves inwards. In the fully retracted position, as before the chamber abutment 430 is fully engaged with the yoke—a further abutment 436 now being in a position behind the chamber abutment 430.

When the chamber is to be withdrawn the chamber abutment 366 acts on the further abutment 436, to force the yoke outwards. The slope of the surface 434, transforms the outward force on the yoke, to outwards and upwards components, to a point where the chamber abutment 430 is unengaged with the further abutment 436 and the chamber may be freely withdrawn.

The arc 438 of the spring 428 is centred about a mid point on the cam surface 434. Thus in the retracted position the spring 428 forces the closure 420 downward onto the chamber. In the withdrawn position, the spring 428 forces the closure 420 upwards clear of the chamber. Thus in both such positions the closure will stay mechanically locked in place until force is applied by the chamber abutment 430.

It will be appreciated that while these closure mechanisms have been described with reference to a cabinet-less drawer dishwasher, they are applicable to drawer dishwashers in general.

Alternative Embodiments

With a dishwasher thus described as the present invention, it will be appreciated that a number of methods exist for effecting sealing of the wash chamber. Below are described examples of alternative sealing apparatus designed for use with the present invention so described.

Figure 18:
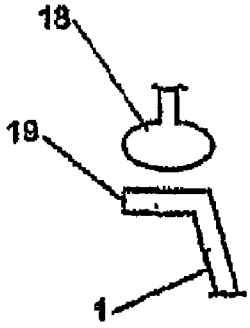
FIGS. 18 and 19 show in diagrammatic form a means of sealing an open top wash chamber with a rigid lid using an inflatable gasket.
Figure 19:
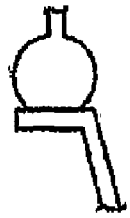
Figure 20:
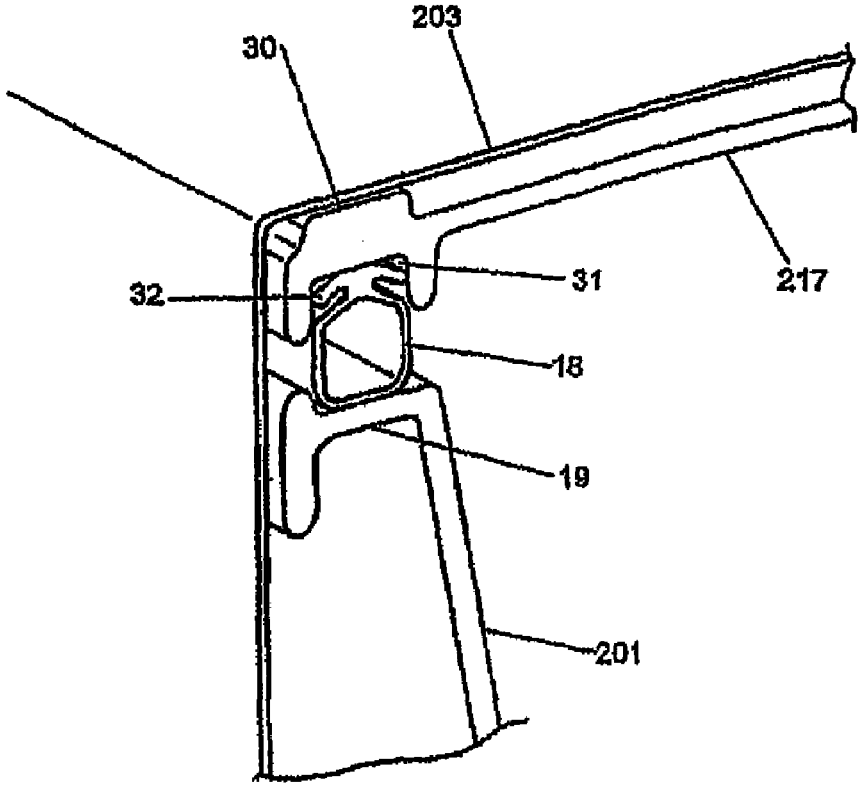
FIG. 20 shows a partial section through a dishwasher incorporating the sealing method shown in FIGS. 18 and 19, FIGS. 21 and 22 show an alternative method of sealing an open topped wash chamber with a rigid lid.
Figure 31:
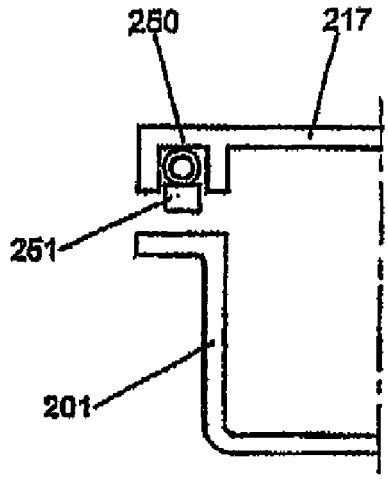
FIG. 31 shows a diagrammatic view of an alternative construction for closing a wash chamber when a fixed lid is used.

The first of these is illustrated diagrammatically in FIGS. 18 to 20. In this case a rigid lid 217 is used as previously described, but is fixed in position above the closed wash chamber 201 and fitted with a peripheral inflatable gasket 18 located in vertical registration with rim 19 of wash chamber 201. In this embodiment when the wash chamber is fully retracted, member 18 is inflated as shown in FIG. 19 to sealably engage with rim 19. In this case member 18 is the sealing member, but an equally suitable alternative would be to inflate a sealing member carrier 250 interposed between the lid and sealing member 251 as shown in FIG. 31.

A practical realisation of this embodiment is shown in more detail in FIG. 20. Wash chamber 201 is formed with a flanged rim 19 which in use provides a seat for inflatable gasket 18. In FIG. 20 the wash tub 201 is indicated as being fully retracted with gasket 18 being inflated so as to sealably engage rim 19.

A rigid lid 217 is as described in the preferred embodiment attached to a bracket 400 which is mounted to the stationary carriage of the sliding rails. Lid 217 is essentially fixed in relation to the under bench cavity. Provided at the periphery of its underside is a channel 31 for retaining gasket 18.

Gasket 18 is moulded from an elastic plastics material and is formed as an indefinite length. A ribbed extension 32 is integrally moulded on the top surface of the gasket to engage in channel 31 in lid 217 to thereby engage the gasket to the lid.

Figure 12:
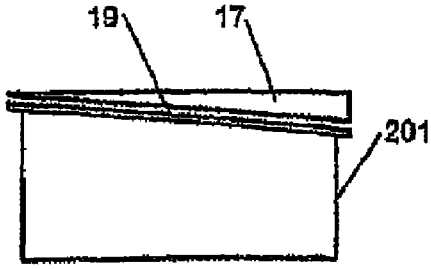
FIG. 12 shows a further method of sealing an open topped wash chamber using a rigid lid.

A further alternative is shown in FIG. 12 where lid 217 and the rim 19 of wash chamber 201 are provided with complementary inclined edges along the sides thereof. A resilient sealing member is disposed about the periphery of lid 17. When wash chamber 201 is fully retracted in cabinet 203 it seals against lid 17 by virtue of the wedging action that results as a result of the fore-aft inclinations of the lid and chamber rim.

In another alternative configuration (not shown) a flat rigid lid is provided with a peripheral flexible gasket which cooperates with means on the wash chamber rim so that positive sealing between the lid and wash chamber is achieved by a pure sliding action when the chamber is retracted.

Figure 13:
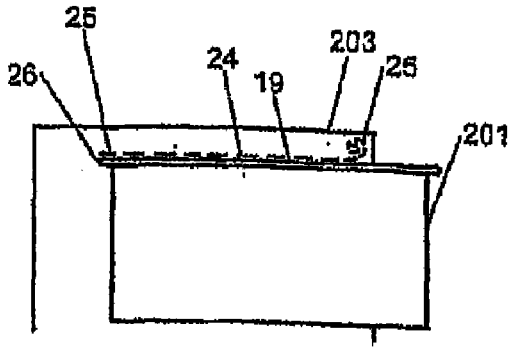
FIG. 13 shows a method of sealing an open topped wash chamber using a flexible closure member.
Figure 14:
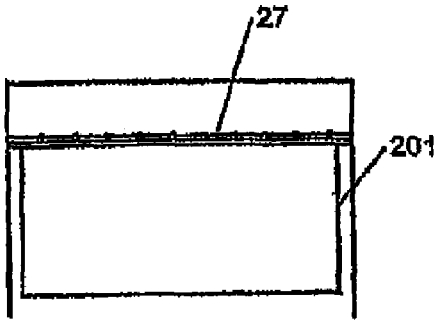
FIGS. 14 and 15 show an alternative method of sealing an open topped wash chamber using a flexible closure.
Figure 15:
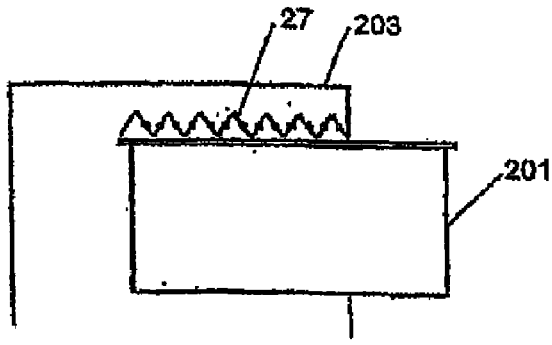

FIGS. 13 to 15 show alternative embodiments where instead of the use of a rigid lid, a flexible closure is used. In FIG. 13 a curtain type closure 24 is fixed along edge 25 to the rear segment 26 of wash chamber rim 19. Curtain 24 is retractably stored on a spring-loaded roller 27 mounted in the top front of the dishwasher cavity. When wash chamber 201 is withdrawn, curtain 24 is taken up on roller 25 whereas when the wash chamber is retracted, curtain 24 is played off roller 25 to fully cover the open top of the wash chamber 201.

FIG. 14 shows a flexible closure 27 provided with a concertina type configuration and mounted in slides provided in the top sides of the dishwasher cavity. When the wash chamber 201 is withdrawn as shown in FIG. 15, closure 27 folds up due to concertina action whereas when the wash chamber is retracted as shown in FIG. 14 a closure 27 is opened out so as to lie flat along the top of the wash chamber.

Figure 32:
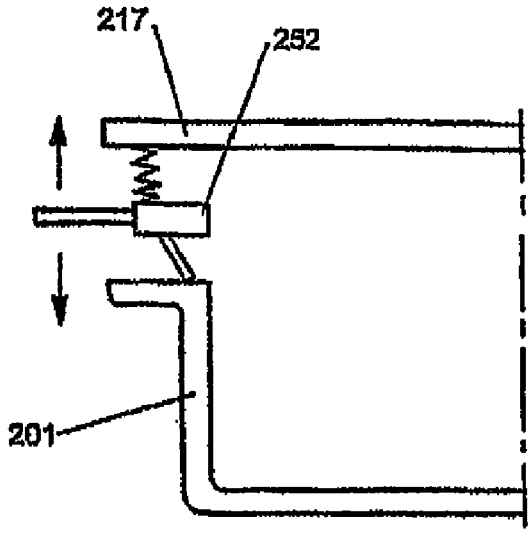
FIG. 32 shows a diagrammatic view of an alternative construction for closing a wash chamber when a fixed lid is used by making use of a moveable seal support carrier.

In addition to using a moving or expanding sealing member onto the top of the wash chamber when it is retracted into the cabinet a separate seal support carrier may be interposed between the periphery of the lid and the sealing member with closure being achieved by lowering the support carrier. This is shown in FIG. 32, where a seal support carrier 252 is attached to lid 217 by an expandable skirt 253. A variety of actuator means giving reciprocal motion can be used to move the seal carrier.

Figure 35:
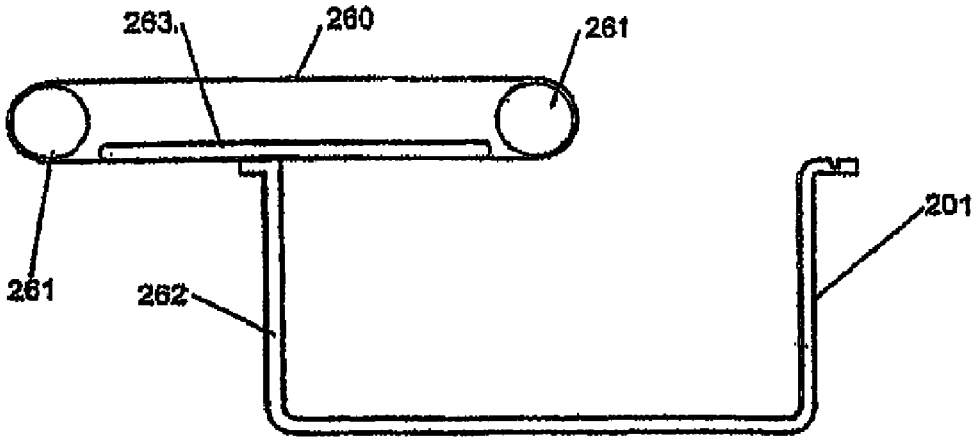
FIG. 35 shows diagrammatically yet a further alternative closure system for a wash chamber using an endless belt.

An alternative flexible closure arrangement is shown in FIG. 35. An endless belt 260 mounted on rollers 261 having a width equally to the width of the wash chamber and spacing between rollers approximately equal to the length of the wash chamber covers the top of the chamber when it is fully retracted.

The rollers 261 are mounted at a fixed height in the top of the dishwasher cavity. The top edge of the rear wall 262 of the chamber is fixed to the belt 260 so that it is rotated and given the same linear motion as the chamber as it is slid closed. A pressure pad 263 may be used to ensure sealing of the belt against the wash chamber and the belt may be stiffened by a series of spaced apart transverse battens.

In the embodiments so far described the closure 217 is essentially fixed in the vertical direction within the cavity, whether rigid or flexible. In the following embodiments the closure is moved downwards by various means to sealably close the open top of wash chamber 201.

Figure 16:
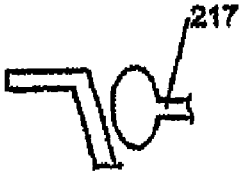
FIGS. 16 and 17 show diagrammatically a further method of sealing an open topped wash chamber with a rigid lid.
Figure 17:
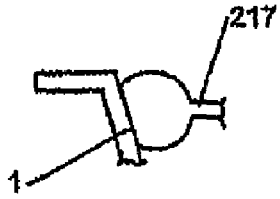
Figure 21:
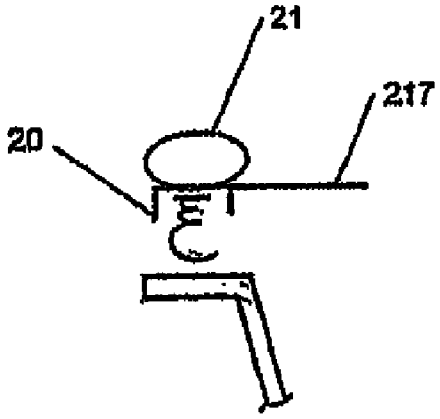
Figure 22:
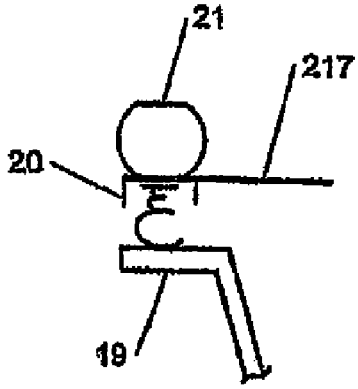

A first such embodiment is shown in FIGS. 21 and 22. Here a peripheral resilient sealing member 20 is disposed on the underside of lid 217 while an inflatable annular member 21 is used to force lid 217 downward in a vertical direction to seal against rim 19 of the wash chamber as shown in FIGS. 16 and 17.

Figure 23:
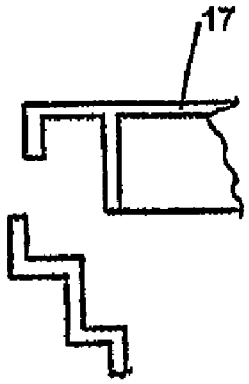
FIGS. 23 and 24 show diagrammatically a further method of sealing an open topped wash chamber with a rigid lid.
Figure 24:
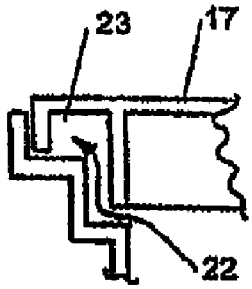

A further embodiment is shown in FIGS. 23 and 24. Here lid 217 is mounted in the top of the cavity so as to be movable in a vertical direction from the position shown in FIG. 23 to the position shown in FIG. 24. Sealing is achieved by providing flange configurations around the edge of the lid and in the top of the wash chamber wall so that when closed, as shown in FIG. 24, an impassable labyrinthic fluid path 22 is formed to thereby effectively seal the wash chamber. The lid and wash chamber flange configuration form a pressure equalisation chamber which ensures wash liquid does not escape. This configuration of lid can also be used in a fixed lid mode if the rear wall of the wash chamber is of reduced height to provide clearance for the lid flanges as it is slid into the closed position.

Figure 36:
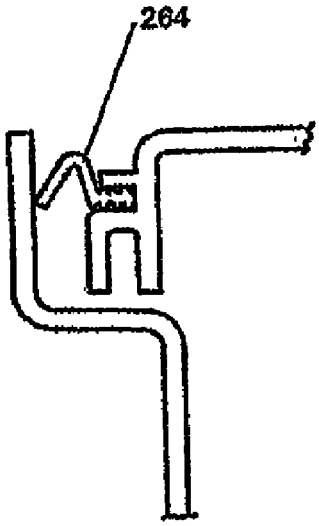
FIGS. 36 and 37 show supplementary sealing members for a wash chamber closure.
Figure 37:
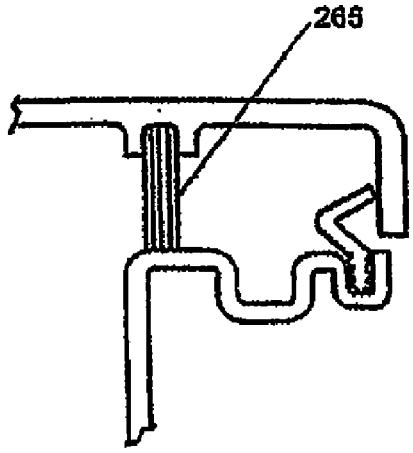

In addition to the labyrinthic path configuration sealing may be assisted by flexible deformable sliding members 264 shown in FIG. 36 and/or by a linear brush member 265 shown in FIG. 37.

Figure 33:
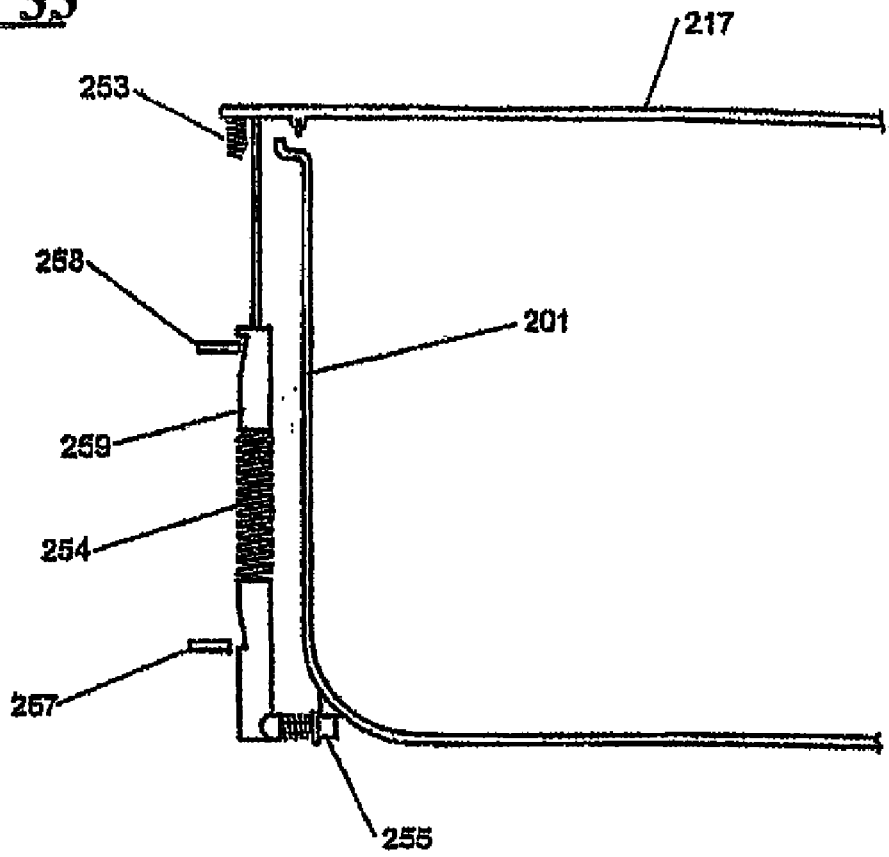
FIG. 33 shows a diagrammatic cross-section of a wash chamber and associated lid which is lowered to close the wash chamber by a stored spring energy system.
Figure 34:
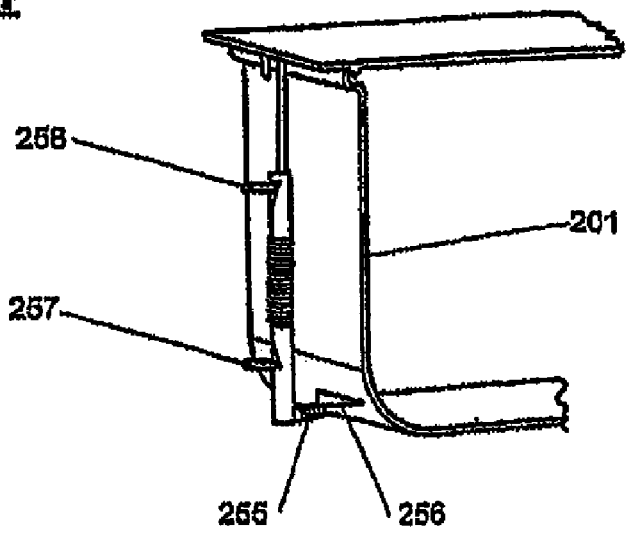
FIG. 34 shows a partial isometric cross-section of the mechanism illustrated in FIG. 33.

An alternative means of raising and lowering a rigid lid is shown in FIGS. 33 and 34. Compression springs 253 apply a lifting force to lid 217 and maintain it in a normally open position. Tension springs 254 are used to apply a closing force to the lid when the wash chamber is fully retracted. Tension is applied by a roller 255 attached to one end of the spring travelling over cam or ramp 256 prior to full retraction of the wash chamber. A latch 257 maintains tension in the spring after the roller has passed over cam 256. This is released when it is later desired to raise the lid. A second latch 258 takes the downward force due to the extended spring 254 until the wash chamber is fully retracted whereupon it releases member 259 to allow a closing (lowering force) to be applied to lid 217.

Figure 38:
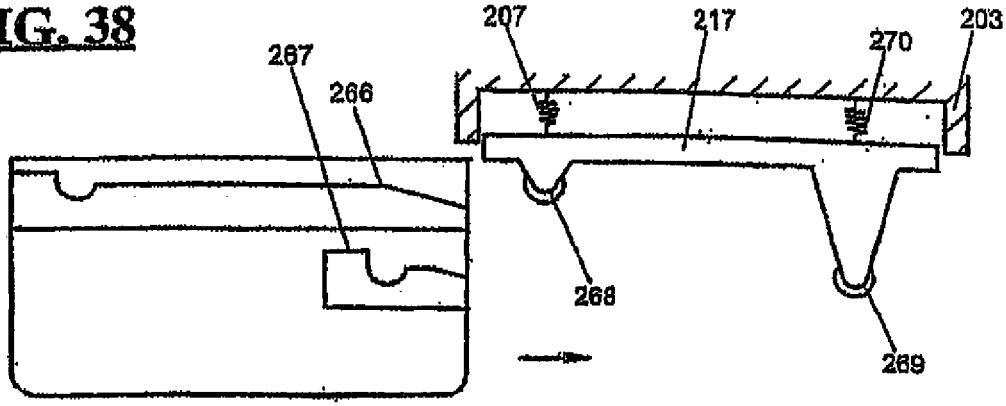
FIGS. 38 to 40 show diagrammatically a wash chamber closure system employing a spring loaded cam and cam follower lid lowering mechanism.
Figure 39:
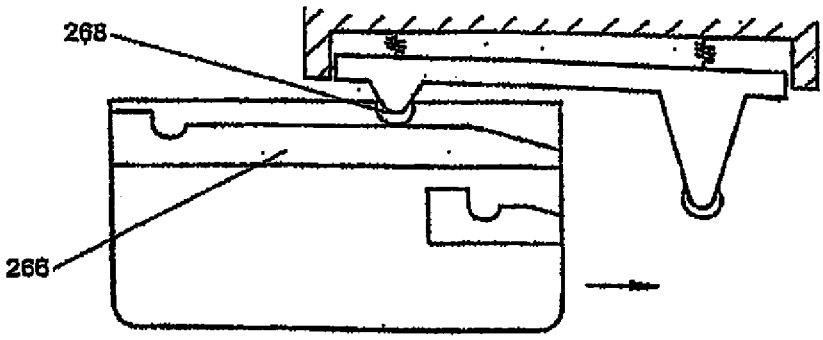
Figure 40:
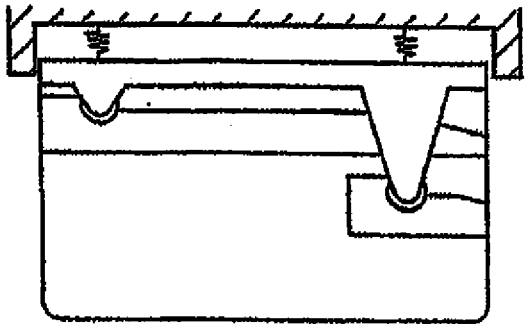

Another mechanism for raising and lowering a rigid lid is shown in FIGS. 38 to 40. A cam and cam follower arrangement is used as follows. Lid 217 is mounted in the top of the cavity on compression springs 270 although restricted against horizontal movement. Wash chamber 201 is provided with cam surfaces 266 and 267 on the outside of each side wall which engage corresponding rollers 268 and 269 as the chamber is moved horizontally to the retracted position. Surface 266 first contacts roller 268 and causes the front of lid 217 to lift as shown in FIG. 39. Similarly surface 267 contacts roller 269 and lifts the rear end of lid 217 as the wash chamber is retracted further. At the end of horizontal travel (FIG. 40) the rollers move down into the semi-circular portions of cam surfaces 266 and 267 under the influence of springs 270 to lower the lid 217 onto the top of the wash chamber and close it.

This cam and cam follower technique can be used with the wedged configuration of lid and wash chamber walls which was shown in FIG. 18. This can assist in achieving an increased sealing force by providing a vertical force component in addition to the horizontal component caused by pushing the wash chamber into the cavity. A cam and cam follower arrangement can also be used to raise and lower the rear end of the lid in constructions where the front of the lid is pivoted about a transverse horizontal axle at a fixed height in the upper front of the cavity.

The invention claimed is:

1. A washing appliance comprising:

a) an open top wash chamber adapted to accommodate items to be washed and within which wash liquid is circulated, said wash chamber having a top peripheral rim, and wherein said chamber is slidably mounted in said appliance in such a manner that it may be withdrawn horizontally for access thereto, b) a wash chamber lid including a perimeter seal to seal on said top peripheral rim, and said lid suspended in said appliance so as to be moveable from an outer position to an inner position, c) a cam surface sloping downward from an outer location to an inner location, separated by a horizontal distance equivalent to the horizontal spacing of said inner and said outer position of said lid, d) a cam follower on said lid and adapted to interact with said cam surface, e) an abutment on said wash system, f) a complimentary abutment on said lid, wherein said abutments meeting when said wash chamber is substantially retracted, and with continue displacement of said wash chamber to a fully retracted location, forcing said lid from said outer position to said inner position, said cam follower cooperating with said cam surface to direct the path of said lid in moving from said outer position to said inner position, to an inward and downward movement, followed by an inward movement, said downward movement of said lid bringing said seal into contact with said peripheral rim, and said inward movement preventing substantial slip between said lid and said wash chamber.

2. A washing appliance as claimed in claim 1, wherein said elastically deformable member forces said closure upwards when said chamber is in a withdrawn position.

3. A washing appliance as claimed in claim 1, wherein said elastically deformable member forces said closure downwards onto said chamber when said chamber is in a retracted position.

4. A washing appliance as claimed in claim 1, wherein said cam surface is substantially stationery with respect to said appliance.

5. A washing appliance comprising:

a) an open top wash chamber adapted to accommodate items to be washed and within which wash liquid is circulated, said wash chamber having a top peripheral rim, and wherein said chamber is slidably mounted within said appliance in such a manner that it may be withdrawn horizontally for access thereto, b) a wash chamber closure, c) a camming arrangement including:

i. a cam surface attached to a stationery point, ii. a cam-follower connected to said closure and adapted to interact with said cam surface, iii. an elastically deformable member adapted to be compressed between said closure and a stationery point to move said closure, and wherein said camming arrangement provides said closure with two degrees of freedom such that when said chamber is slid into a refracted position said closure moves inwardly and downwardly, and when said chamber is slid into a withdrawn position said closure moves outwardly and upwardly, d) complementary abutments provided on said closure and said wash chamber, said abutments engaging on substantially full retraction of said wash chamber within said appliance and on initial withdrawal of said washer chamber, and wherein continued displacement of said wash chamber after engagement, providing respective closing and opening forces to said closure, to cause it to close against or open away from said wash chamber opening.

6. A washing appliance as claimed in claim 5 wherein, said elastically deformable member is a torsional spring.

7. A washing appliance as claimed in claim 5, wherein said elastically deformable member forces said closure upwards when said chamber is in a withdrawn position.

8. A washing appliance as claimed in claim 5, wherein said elastically deformable member forces said closure downwards onto said chamber when said chamber is in a retracted position.

9. A dishwasher constructed according to the washing appliance as claimed in any one of the claims 6, 7 or 8.

* * * * *